US006199309B1

(12) United States Patent
Markarian

(10) Patent No.: US 6,199,309 B1
(45) Date of Patent: Mar. 13, 2001

(54) MERCHANDISING MARKERS ACCOMODATING ANTI-THEFT SENSOR

(75) Inventor: Vark Markarian, Cranston, RI (US)

(73) Assignee: Contempo Card Company, Inc., Providence, RI (US)

( * ) Notice: Subject to any disclaimer, the term of this patent is extended or adjusted under 35 U.S.C. 154(b) by 0 days.

(21) Appl. No.: 09/167,199

(22) Filed: Oct. 6, 1998

(51) Int. Cl.[7] ..... G09F 3/10

(52) U.S. Cl. ..... 40/299.01; 40/638; 40/673; 206/6.1

(58) Field of Search ..... 40/299.01, 630, 40/638, 662, 663, 664, 673; 340/572.1, 568.8; 206/6.1

(56) References Cited

U.S. PATENT DOCUMENTS

| | | | | |
|---|---|---|---|---|
| 4,510,489 | | 4/1985 | Anderson, III et al. . | |
| 4,510,490 | * | 4/1985 | Anderson, III et al. | 340/572.1 |
| 4,584,571 | | 4/1986 | Smit et al. . | |
| 5,057,095 | * | 10/1991 | Fabian | 340/572.5 X |
| 5,081,446 | | 1/1992 | Gill et al. . | |
| 5,197,596 | * | 3/1993 | Garganese | 206/6.1 |
| 5,239,284 | | 8/1993 | Hara et al. . | |
| 5,347,508 | * | 9/1994 | Montbriand et al. | 369/273 |
| 5,414,412 | * | 5/1995 | Lian | 340/572.2 |
| 5,499,015 | | 3/1996 | Winkler et al. . | |
| 5,583,489 | * | 12/1996 | Loemker et al. | 340/572.8 |
| 5,593,025 | * | 1/1997 | Feibelman | 206/6.1 |
| 5,777,553 | * | 7/1998 | Perreau et al. | 340/572.5 X |
| 5,790,029 | * | 8/1998 | Curnutte et al. | 340/572.1 |
| 5,841,348 | * | 11/1998 | Herzer | 340/551 |
| 5,873,457 | * | 2/1999 | Madweb | 206/6.1 X |
| 5,884,425 | * | 3/1999 | Baldwin | 40/630 X |
| 5,969,612 | * | 10/1999 | Gadonniex et al. | 340/572.1 X |
| 6,018,296 | * | 1/2000 | Herzer | 340/572 |

* cited by examiner

*Primary Examiner*—Terry Lee Melius
*Assistant Examiner*—James M Hewitt
(74) *Attorney, Agent, or Firm*—Nixon Peabody LLP

(57) ABSTRACT

A merchandising marker such as a tag or card including an electronic article surveillance (EAS) security device for use with EAS systems in order to protect merchandise from unauthorized removal from a controlled area. The security device can be embedded into the marker to form a unitary structure.

5 Claims, 4 Drawing Sheets

MERCHANDISING MARKERS ACCOMODATING ANTI-THEFT SENSOR

BACKGROUND OF THE INVENTION

1. Field of the Invention

The present invention relates to merchandising aids and security systems, and more particularly to a merchandising marker, such as tag and card assemblies, accommodating an anti-theft security device integral therewith.

2. Background

Merchandising markers are known for attaching product information, price and stocking information to merchandise. Typically, these markers will comprise a flat tag member usually made of cardboard. Markers are attached to a piece of merchandise by different means. Some markers are attached by adhesive means; others are attached by means of a tether or loop of material, such as polyethylene, to hold the marker to the merchandise.

Markers in the form of display cards are also known for holding jewelry, particularly earrings, for display on merchandise racks. Cards will also have a means for securing the merchandise, such as a jewelry product, to the card such as a pair of holes for passing the posts of pierced-ear style earrings through, which will retain the earrings on a front face of the card when a clasp is affixed onto the posts after mounting to the card. Other mounting arrangements are also common for retaining clip-on style earrings, bracelets, anklets, and the like. The cards generally also have a means for hanging the card with its jewelry attached on a display. For example, a hole for receiving a rod or peg such as a J-bar, or a pair of 90 degree bends in the card to form a channel for hooking the card over a horizontal rod.

Jewelry cards of the known variety allow the attractive display of the items they carry. They allow for the portable display of jewelry, and due to their small size, allow potential customers to examine the jewelry product adjacent to similar product, against clothing items with which the purchaser desires them to accent, and against the face of the buyer to gauge the product's appeal. Because the jewelry is allowed to hang from the jewelry card, the jewelry can be observed on display in a natural state, a state that also helps avoid tangling of ornamental chains or other dangling elements.

Jewelry cards of the known variety are also convenient for shipping and storing earrings, which come in matched pairs and are best not separated.

Unfortunately, while jewelry cards of the known varieties have been effective in the transport, storage, and display of jewelry, their small and portable size renders them a relatively easy object of theft. Because jewelry can be valuable on a per-unit basis, it would be desirable to provide for certain security features on jewelry cards to help reduce the instances of theft.

Likewise, the prior art merchandising markers in the form of tags attached to articles offer no anti-theft benefits. In the example of another high-theft item, sunglasses, a prior art merchandising marker bearing price information can be easily removed from the sunglasses, allowing a thief to abscond with the product undetected.

Security or electronic article surveillance (EAS) systems in retail environments are known. These systems typically comprise a detection device, located usually at a controlled entrance/exit point to where the merchandise is on display, and a security element that is attached to the merchandise. If the merchandise is moved through the controlled entrance/exit without disabling the security element, an alarm will sound. Typically, these security elements are removed from the product or otherwise disabled by an attendant of the merchant after a sale is transacted, allowing the purchaser to exit without sounding the alarm.

One well-known system for EAS is the swept-RF system. Swept-RF systems, such as the Impulse® system of Checkpoint Industries, utilize a small RF (radio frequency) pressure-sensitive label that is attached to the product. These labels contain a tiny RF-printed passive circuit. A pedestal is placed on either side of an entrance or exit and creates an RF field. If a label that has not been deactivated passes through the field, it will cause the RF circuit to resonate at a frequency detectable by the pedestal, and trigger an alarm. Current trends in manufacturing include "source tagging", where the manufacturer includes an EAS-active or activateable element in or on the packaging of the merchandise.

It is known that swept-RF labels, which are pressure sensitive adhesive-based thin labels, may be applied to merchandise or to earring cards. Significant problems, however, are inherent in swept-RF technology that make an EAS system based on swept-RF less effective for monitoring merchandising. First, the security element of a swept-RF EAS system, which is in the form of a label, may be peeled from the product, thus defeating it's protection. Because small items of merchandise and jewelry cards have limited available surface area, it is difficult to place the security element in such a way that it cannot be peeled off.

U.S. Pat. No. 5,593,025 suggests one solution to the problem by proposing a jewelry card that is folded to form an interior volume for accommodating a swept-RF security element. This solution, however, uses more than twice as much card material as is necessary and increases environmental detriment as a result. Further, the resulting shape occupies a far greater space in terms of its depth, thus decreasing the amount of jewelry merchandise which may be exhibited on a given display rack.

Further problems exist with swept-RF EAS systems. One large problem is security element degradation that can result from exposure to humidity, static electricity and other electronic noise.

Another major problem which results when automated procedures are attempted to be used to apply swept-RF labels to merchandising markers is one of registration, or the alignment of the label on the earring card. Many merchandising markers, particularly jewelry cards, require printed indicia or graphics for marketing purposes, which are also typically provided on adhesive labels. In automated assembly of a merchandising marker, conventional assembly lines are not equipped to allow registration of the swept-RF label and the graphics label simultaneously on the marker body.

Another prevalent format for EAS systems is known as magnetomechanical or acousto-mechanical technology. Acousto-mechanical systems, such as the Ultra-Max® of Sensormatic Electronics Corporation, utilizes a security device comprising a first relatively elongated element of high magnetic permeability ferromagnetic material disposed adjacent to another ferromagnetic element having higher coercivity. When an interrogation frequency from an EAS pedestal strikes the pair, the security device causes harmonics of the emitted signal to develop in a receiving coil. The result is a reliable EAS system, with detection or "pick" rates of 90%.

Acousto-mechanical security devices are, by nature of their bi-elemental construction, not as thin as swept-RF markers, and thus are more conspicuous. The security devices usually are packaged in a small plastic box, usually white, which is just large enough to accommodate the ferromagnetic elements. The small plastic box is usually attached to an article by adhesive. The result is a rather conspicuous EAS security device.

Both swept-RF and acousto-mechanical security elements provide the unfortunate disadvantage of rendering protected and unprotected merchandise easy to differentiate, diluting the so-called "halo effect," which results when a potential shoplifter is not sure whether an article is protected or not. In the case of jewelry cards, it also provides the potential shoplifter, upon identifying the security device, with an incentive to remove the merchandise from the card in an effort to defeat any anti-theft measures. In the case where a merchandising marker bearing the security element, such as a tag, is easily detached from the merchandise, a conspicuous sensor provides an incentive to remove the marker from the merchandise.

The prior art does not address the need to provide a merchandising marker having an inconspicuously included EAS security device that uses only the amount of stock material necessary and maintains a compact configuration.

SUMMARY OF THE INVENTION

The present invention provides a merchandising marker, such as a tag or card, having an inconspicuously included security device for superior performance in an EAS. The marker is made of only the amount of material necessary so as to prevent excess ecologically undesirable waste in a disposable marker. The present invention also provides a compact configuration that does not unnecessarily expand the displaced volume of the marker, allowing more compact packing and shipping of the markers, and in the case of a jewelry card, more compact display of merchandise mounted thereon. Further, the instant invention provides ambient protection of the EAS security device from humidity and static electricity.

The invention further provides for merchandising markers having inconspicuously included EAS security devices. The invention provides for the embedding of the security device into the marker, or for the laminating over the security device to obscure it from sight.

A further advantage of the invention is that it provides a means for registering a swept-RF EAS security device on the marker body simultaneously with graphics- or indicia-bearing front labels in an automated manner.

Other aspects of the invention are disclosed infra.

BRIEF DESCRIPTION OF THE DRAWINGS

The aforementioned and other features and advantages of the present invention will become more apparent in view of the following detailed description in conjunction with the accompanying drawing, of which.

DETAILED DESCRIPTION OF AN ILLUSTRATIVE EMBODIMENT

The present invention will be described herein with reference to illustrative embodiments of merchandising markers including a security element for use with EAS systems in order to protect merchandise from unauthorized removal from a controlled area. As discussed herein, the term "marker" shall apply to tags, booklets, cards, or any other merchandising aid carrying or attached to merchandise for presenting information or promotional images.

Figure 1:
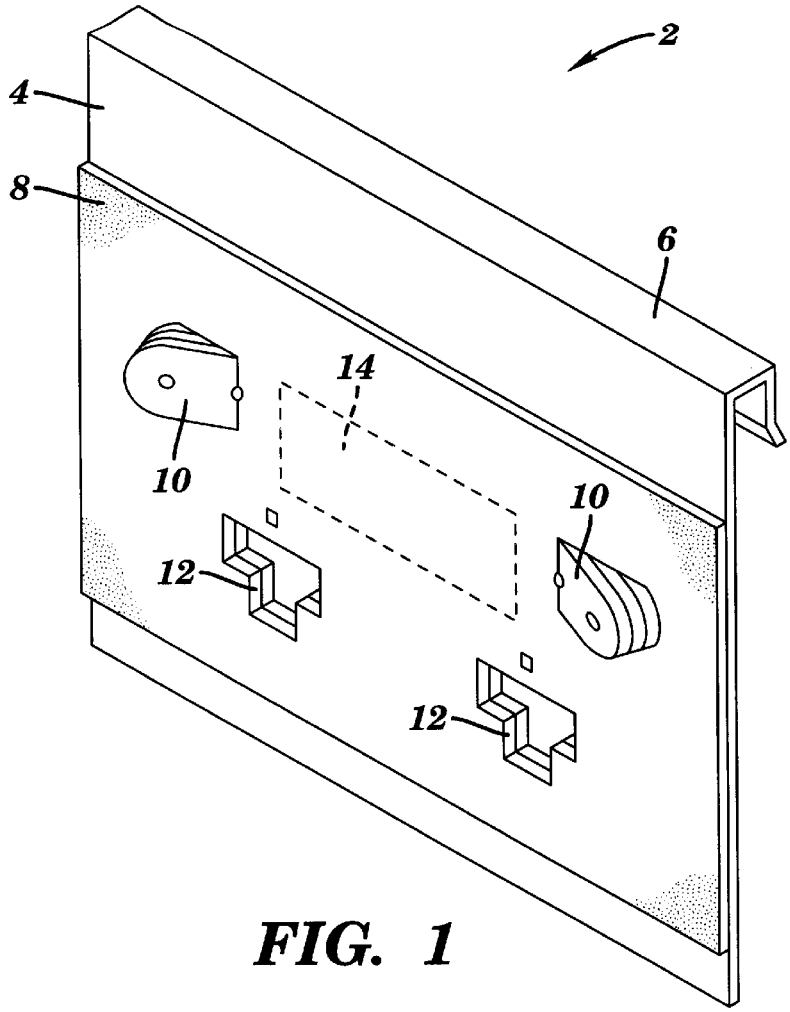
FIG. 1 depicts a jewelry card having a security device embedded therein.

In general, an illustrative embodiment of a marker in the form of a jewelry card 2 of the present invention is depicted in FIG. 1. The card may comprise a generally flat body 4 which at a top edge thereof may have a hanger which as illustrated may comprise a hook portion 6, which may be rounded as illustrated or comprise a pair of 90-degree bends to form a box-type channel. Other types of hangers are of course usable, such as a hole for accommodating a hanging post or peg, such as a J-bar. A portion of the front face of the card also includes a display area 8 that may optionally be covered with a textured, colored, or indicia-bearing surface to display mounted jewelry in a more pleasing fashion.

The display area 8 may also include retainers 10 for pierced-ear style earrings, and may also include cutouts 12 for mounting clip-style earrings, bracelets, necklaces or the like. The retainers 10 may alternatively also be holes or cutouts. Similar cards may of course be made for merchandising other items, as desired.

Figure 2:
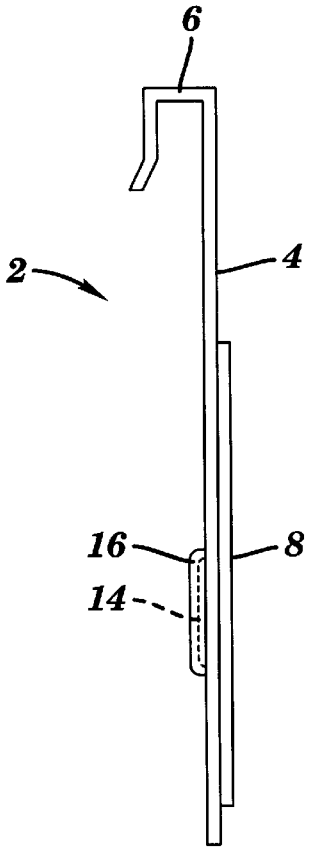
FIG. 2 depicts the jewelry card of FIG. 1 having a security device laminated thereon.

An EAS security device 14 is mounted in the body 4. As further seen in FIG. 2, the security device 14 can be embedded into a cavity well 16 formed in the card. The cavity well may be molded into the card, or alternatively bonded onto the card adjacent to a cutout in the card. The security device 14 may then be covered by the display area's textured or colored laminate, which may be graphics- or indicia bearing. The security device 14 may be of the swept-RF or acousto-mechanical variety, and will, accordingly, vary in shape. Other security devices not yet commercially available are of course foreseen to be included.

Usually, if the display area is to include graphics or indicia, such as a brand name trademark and the like, the graphics or indicia are position-sensitive with respect to the card. For example, a trademark might have to be aligned across the top edge of the display area 8. Such display areas are conventionally supplied in a web form, individual display areas 8 being cut from the web and applied to the backing during assembly. Because the content is position-sensitive, the display area 8 must be registered on the backing. According to the invention, the EAS security device may be advantageously placed before registration of the display area, for example, using suction robotics on the assembly line. Because the security device is placed beforehand, for example in a cavity well, the display area may be registered on the card backing, using for example die-cutting punches available on assembly lines. Such placement of the sensor dispenses with the complexity involved in having to register, for example, label-type EAS security devices on the backing simultaneously with the display area, which conventional assembly lines are not equipped for.

A further advantage of the instant invention resides in the fact that different types of sensors may be provided during assembly without substantial modification to the assembly process. The cavity well may be formed beforehand to accept any of a plurality of different types of sensors, allowing for the same marker bodies and assembly process to be used. This is a particular advantage when providing jewelry cards intended for different distribution channels using different anti-theft technologies.

Figure 3:
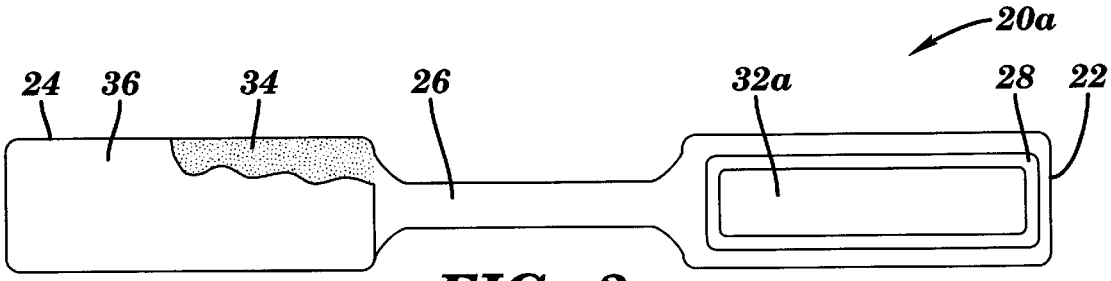
FIG. 3 depicts a top plan view of a merchandising tag having a security device embedded therein.
Figure 4:
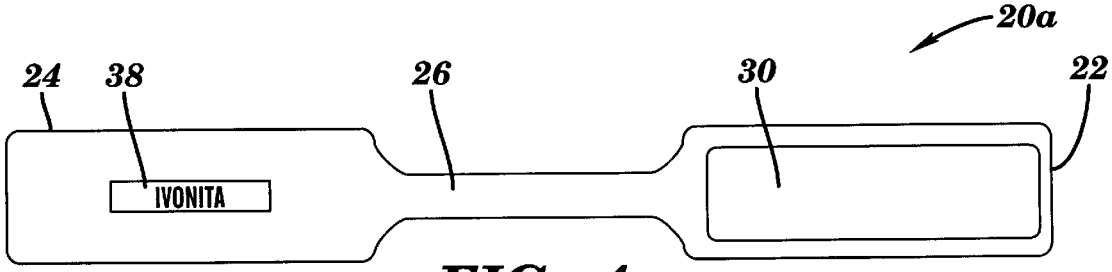
FIG. 4 depicts a bottom plan view of the tag of FIG. 3.
Figure 5:
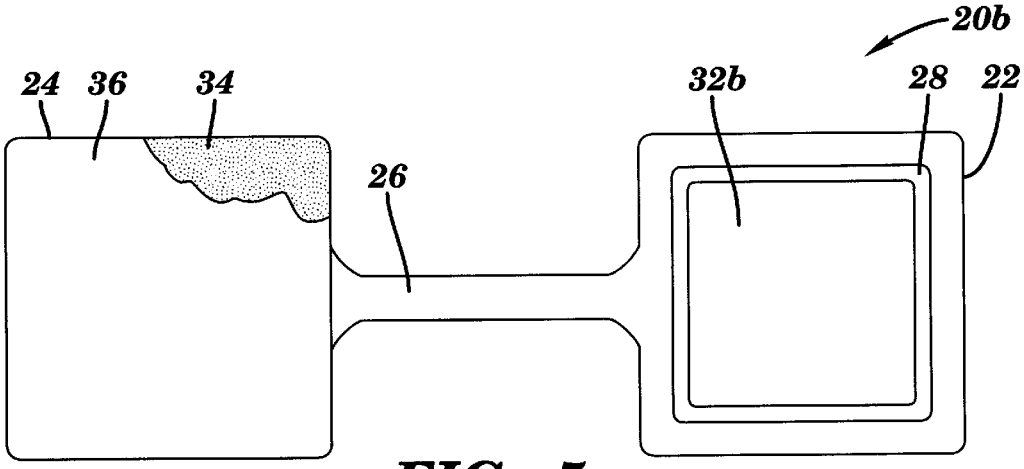
FIG. 5 depicts a top plan view of another embodiment of a merchandising tag having a security device embedded therein.
Figure 6:
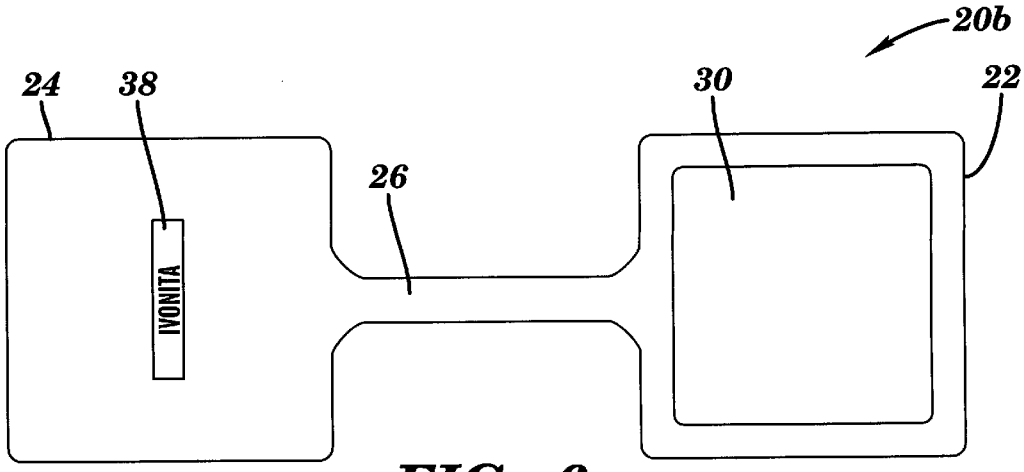
FIG. 6 depicts a bottom plan view of the tag of FIG. 5.

Turning now to FIGS. 3 through 7, two embodiments of a merchandising marker in the form of a tag according to the present invention are depicted. Because of the similarity of the embodiments, similar elements are referred to by like reference numerals. A tag body 20 may be configured to any suitable size, as illustrated by tag body 20*a* of FIGS. 3 and 4, and tag 20*b* of FIGS. 5 and 6. The tag bodies have a first ear 22 and a second ear 24, which are shaped so as to correspond substantially in a mirror-image manner. A tether 26 connects the ears 22 and 24 to each other. The ears 22, 24 and the tether 26 are preferably formed of a single piece of tear-resistant flexible plastic. The first ear 22 is formed with a cavity well 28, which can be stamped or otherwise formed in the ear 22. The back side of the cavity well 30 appears on the back side of the ear 22 as a raised portion, as depicted in FIGS. 4 and 6. The cavity well is of a depth to receive therein a security device 32. FIG. 3 depicts a magneto-acoustical security device 32*a*, and FIG. 5 depicts a swept-RF security device 32*b*.

Figure 7:
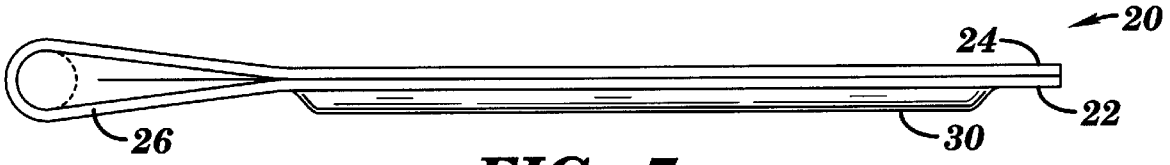
FIG. 7 depicts a side view of the tag of either FIG. 3 or FIG. 5 in a folded configuration.

The second ear 24 of the tag is provided with an adhesive 34, which may be covered by a backing 36. The back side of the second ear 24 can bear indicia 38. To attach the tag to merchandise, any backing 36 is removed from the second ear 24, and the adhesive 34 on the second ear is applied to the first ear 22 so as to seal the security device 23 in the cavity well 28. FIG. 7 depicts the tag in an attached, folded orientation. In a preferred embodiment, the tag is made of tear-resistant plastic, such that it can be conveniently removed only by cutting. Preferably, the adhesive is very aggressive, such that the tag cannot be easily peeled apart once attached to a piece of merchandise.

Figure 8:
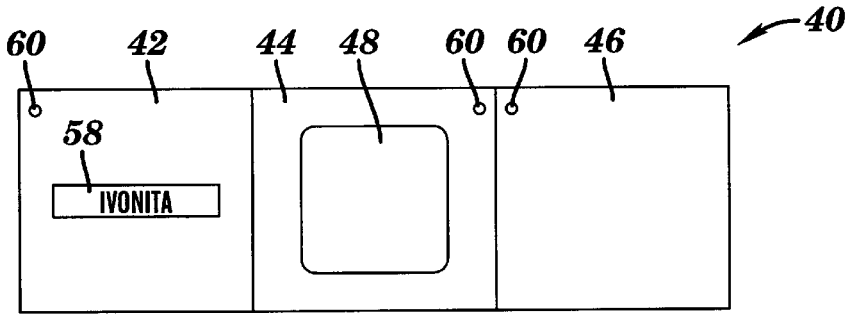
FIG. 8 depicts a bottom plan view of a booklet-style merchandising tag.
Figure 9:
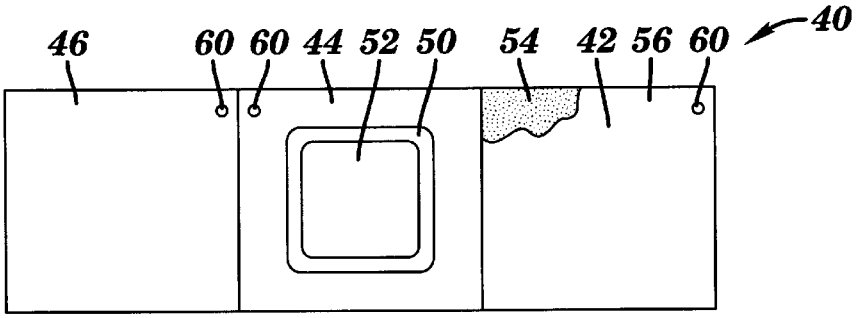
FIG. 9 depicts a top plan view of the tag of FIG. 8 having a security device embedded therein.
Figure 10:
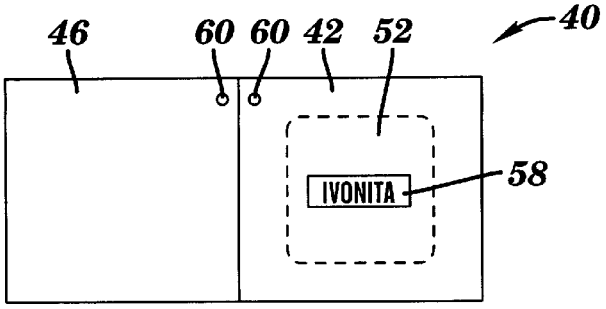
FIG. 10 depicts a top plan view of the tag of FIG. 8 in a partially folded orientation.
Figure 11:
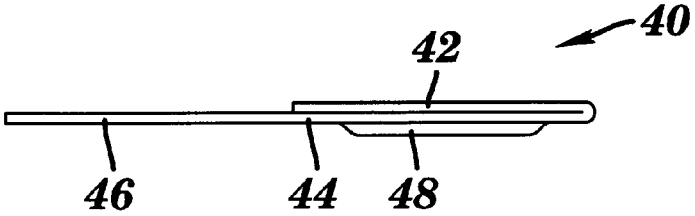
FIG. 11 depicts a side view of the tag of FIG. 8 in a partially folded orientation.

Turning now to FIGS. 8–11, a booklet-style tag body 40 according to the present invention is depicted. The tag body is comprised of three substantially equal sized panels 42, 44, and 46. The center panel 44 is shown in FIG. 8 with the back side 48 of a cavity well, which appears as a raised portion. In FIG. 9, panel 44 is depicted having a cavity well 50, which accommodates therein a security device 52. The booklet of the figures depicts a swept-RF type security device, but an acousto-mechanical security device could also be used with appropriate changes to the dimensions. The first panel 42 comprises an adhesive coating 54, which can be covered by a backing material 56. The back side of the first panel 42 can bear indicia 58. To assemble the booklet, any backing 56 is removed from the front side of the first panel 42, and the adhesive 54 on the first panel is applied to the second panel 44 so as to seal the security device 52 in the cavity well 50. FIG. 11 depicts the tag in a folded orientation. In a preferred embodiment, the tag is made of tear-resistant plastic. Preferably, the adhesive is very aggressive, such that the tag cannot be easily peeled apart. The panels 42, 44, and 46 are preferably provided with holes 60, which align when folded such that a tether may be passed through the holes and affixed to merchandise. The tether (not shown) should be of flexible, break-resistant material, such as polyethylene plastic. The booklet may be provided with indicia on any of the exposed faces after assembly, so as to provide consumer information, promotional literature, SKU bar codes, and the like. FIG. 11 depicts the booklet tag in an assembled orientation, but upon attaching to merchandise, the third panel 46 can be preferably additionally folded to overlie the first panel 42. The third panel 46 may also be folded in an opposite direction to overlie panel 44 where the back side 48 of the cavity well protrudes only a small distance, as in the case where a swept-RF security device is accommodated in the cavity well 50.

Figure 14:
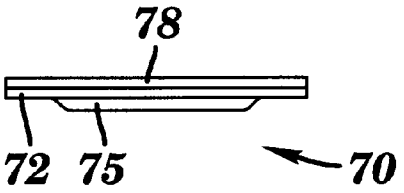
FIG. 14 depicts a side view of the tag of FIG. 12.
Figure 13:
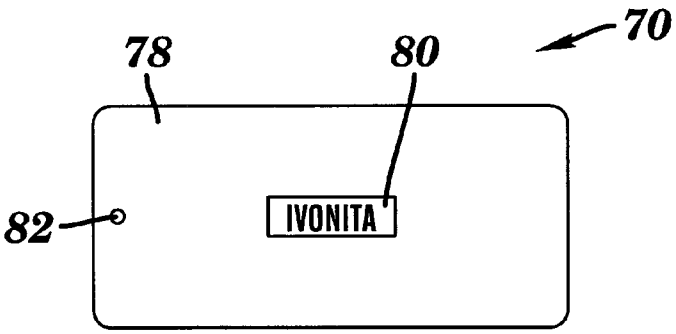
FIG. 13 depicts a bottom plan view of the tag of FIG. 12.
Figure 12:
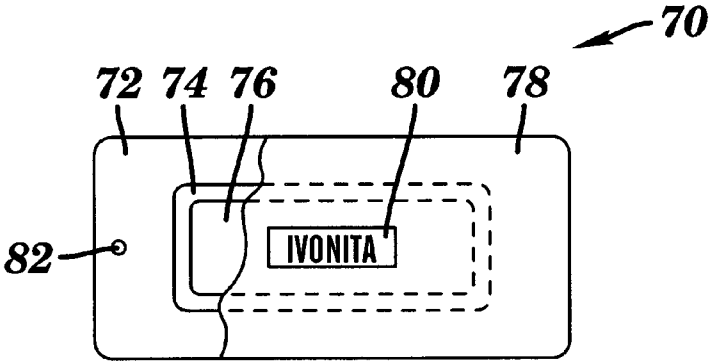
FIG. 12 depicts a top plan view of another embodiment of a merchandising tag having a security device embedded therein.

Turning now to FIGS. 12–14, another embodiment of a tag 70 is depicted. In this embodiment, a tag body 72 is provided with a cavity well 74, the back side 75 of which appears as a raised portion as seen in FIG. 14. The cavity well 74 is sized so as to accommodate a security device 76. As depicted in these figures, the sensor resembles an acousto-mechanical security device, but a swept-RF security device may also be used with appropriate changes to the dimensions. An indicia-bearing substrate member 78 is applied through the use of adhesive to the body 72. The indicia 80 appearing on the member 78 may advantageously comprise price information, consumer information, SKU bar codes, promotional material and the like. A hole 82 is provided to attach the tag to merchandise, for example by a tether passed through the holes and affixed to merchandise. The tether (not shown) should be of flexible, break-resistant material, such as plastic.

The invention has been described in detail with reference to preferred embodiments thereof. However, it will be appreciated that those skilled in the art, upon consideration of this disclosure, may make modifications and improvements within the spirit and scope of the invention.

What is claimed is:

1. A merchandising marker for assisting in protecting an article of merchandise from intentional, unauthorized removal from a controlled area, said marker comprising: a substantially planar body having a first side and a second side, the first side including access to a cavity well formed therein, the second side including a side surface and a raised portion extending outwardly from the side surface and forming said cavity well; a magnetomechanical security device within said cavity well and said cavity well being sized to receive said magnetomechanical security device, said security device comprising a plastic housing and a ferromagnetic element positioned within said housing; and a substrate member adhered to the first side of the body to cover and seal the cavity well.

2. A merchandising marker according to claim 1, wherein:

said substantially planar body further comprises a hanging portion for securing said marker to a display;

at least one of retaining members or cutouts in said body for retaining at least one article of jewelry to said marker.

3. The merchandising marker of claim 1, wherein the body comprises a plurality of panels.

4. The merchandising marker of claim 1, further comprising the substrate member having indicia thereon.

5. A merchandising marker for assisting in protecting an article of merchandise from intentional, unauthorized removal from a controlled area, said marker comprising: a substantially planar body comprising first and second ears connected by a tether, said first ear having a first side and a second side, the first side including access to a cavity well formed therein, the second side including a side surface and a raised portion extending outwardly from the side surface and forming said cavity well; the first and second ears substantially corresponding to each other in planar area; a magnetomechanical security device within said cavity well and said cavity well being sized to receive said magnetomechanical security device, said security device comprising a plastic housing and a ferromagnetic element positioned within said housing; wherein said second ear being sealingly attached to said first ear so as to cover and seal the cavity well.

* * * * *